US011056083B2

(12) United States Patent
Yamaguchi

(10) Patent No.: US 11,056,083 B2
(45) Date of Patent: Jul. 6, 2021

(54) DISPLAY CONTROL DEVICE AND IMAGE DISPLAY METHOD

(71) Applicant: SHENZHEN TOREY MICROELECTRONIC TECHNOLOGY CO. LTD., Shenzhen (CN)

(72) Inventor: Masayuki Yamaguchi, Sakai (JP)

(73) Assignee: SHENZHEN TOREY MICROELECTRONIC TECHNOLOGY CO. LTD., Shenzhen (CN)

( * ) Notice: Subject to any disclaimer, the term of this patent is extended or adjusted under 35 U.S.C. 154(b) by 0 days.

(21) Appl. No.: 16/706,339

(22) Filed: Dec. 6, 2019

(65) Prior Publication Data

US 2020/0184930 A1 Jun. 11, 2020

Related U.S. Application Data

(60) Provisional application No. 62/778,211, filed on Dec. 11, 2018.

(51) Int. Cl.
*G09G 5/37* (2006.01)

(52) U.S. Cl.
CPC ..... *G09G 5/37* (2013.01); *G09G 2320/0233* (2013.01)

(58) Field of Classification Search
CPC .. G09G 5/37; G09G 5/06; G09G 5/30; G09G 3/2803; G09G 2320/06; G09G 2320/0271; H04N 1/6027
See application file for complete search history.

(56) References Cited

U.S. PATENT DOCUMENTS

2008/0106619 A1* 5/2008 Sumiya ..... H04N 5/3675 348/246
2018/0336827 A1* 11/2018 Zahirovic ..... G09G 3/3275

FOREIGN PATENT DOCUMENTS

JP 2007-256779 A 10/2007

* cited by examiner

*Primary Examiner* — Antonio A Caschera
(74) *Attorney, Agent, or Firm* — ScienBiziP, P.C.

(57) ABSTRACT

A display control device outputs an image, which is obtained by processing as input image having been corrected by the correction unit, while correction data is loaded. The display control device outputs the input image, which has been corrected by the correction unit, after completion of loading the correction data.

18 Claims, 3 Drawing Sheets

DISPLAY CONTROL DEVICE AND IMAGE DISPLAY METHOD

TECHNICAL FIELD

The present invention relates to a display control device and an image display method using the display control device.

BACKGROUND ART

To display, on display panels, images whose quality is as high as possible, display apparatuses, including smartphones and TV systems, typically perform correction processes on input image data by using various image processing techniques. Then, output images suitable for the characteristics of the respective display panels are generated, and images are output on the display panels.

Examples of such correction processes include gamma correction for adjusting chroma and brightness so that the color of an image on a display panel is close to the natural color, and edge enhancement for improving the sharpness of an image and achieving easy-to-see display with clear outlines. Other than these, examples of correction processes also include Mura correction and degradation correction of complementing characteristics variations and degradation states of pixels included in individual connected display panels and improving screen uniformity.

In particular, an OLED (Organic Light-Emitting Diode) panel using OLED elements in the pixels has the following issues: characteristics variations of TFT (Thin Film Transistor) elements or OLED elements included in the pixels; and degradation in these element characteristics due to the operating time. Thus, an important point to improve the display quality is how accurately the characteristics variations and degradation of the elements are corrected by using Mura correction and degradation correction.

In contrast, PTL 1 discloses a technique enabling an image to be displayed promptly after powering on a display apparatus. The display control device of the related art stores, in advance in a nonvolatile memory for a command table, an initial-screen control command for displaying an initial screen. The nonvolatile memory for the command table is formed of a nonvolatile memory. After switching on the display apparatus, the display control device displays an initial screen on the display unit (display panel) on the basis of the initial-screen control command during a period from release of the reset state of the display control device to output, from a microcomputer, of a normal-screen control command for displaying a normal screen. Regardless of operations of the microcomputer, the display control device displays an initial screen automatically on the basis of the initial-screen control command. Thus, after power-on, the initial screen is displayed promptly.

CITATION LIST

Patent Literature

[PTL 1] Japanese Unexamined Patent Application Publication No. 2007-256779

SUMMARY OF INVENTION

Technical Problem

One of the correction processes for Mura correction and degradation correction is as follows: on powering on the display apparatus, the display control device loads, for correction, correction data (correction parameters), which is stored in a nonvolatile external memory or the like, for the characteristics variation and the degradation state of each pixel. However, recently, the amount of correction data has increased explosively due to the high definition of display panels, resulting in a longer data load time. For example, in a high-resolution display panel, such as WQHD (Wide Quad High Definition) 21:9 (1440×3200) or 4K (2160×3840), loading correction data and the like may take one second or more.

Therefore, there arises the following problem. In a display apparatus on which an image having been subjected to such a correction process is displayed, a long waiting time from power-on to start of image display provides stress to a user. Possible solutions to suppress the problem include extreme reduction of the correction data and the like and initial display of an image which has not been corrected at all. These solutions may result in a user's recognition of reduction in the display quality or image disturbances in start-up.

Assume the state in which the related art in PTL 1 is applied and in which an initial screen different from the expected display is displayed for a lone time during a waiting time until the corrected image is displayed. This state may similarly result in a user's awareness of the waiting time and may provide stress to the user.

An object of one aspect of the present invention is to implement a display control device which may reduce a time period after power-on to display of an image, and which may generate and display an image from which a user feels less stress during a period until display of the expected image obtained through correction.

An object of one aspect of the present invention is to implement an image display method, for a display control device, which may reduce a time period after power-on to display of an image, and which may generate and display an image from which a user feels less stress during a period until display of the expected image obtained through correction.

Solution to Problem (1) One embodiment of the present invention is a display control device including a correction unit that performs a correction process on an input image based on correction data. While the correction data is loaded, a processed image is output. The processed image is obtained by processing a corrected input image. The corrected input image is obtained through the correction process of the correction unit. After completion of loading the correction data, the corrected input image obtained through the correction process of the correction unit is output.

(2) An embodiment of the present invention is the display control device in which, in addition to the configuration of (1) described above, the correction unit performs the correction process in such a manner that strength of correction increases gradually from start to end of loading the correction data.

(3) An embodiment of the present invention is the display control device in which, in addition to the configuration of (1) or (2) described above, the correction data is loaded by sequentially reading the correction data obtained through classification into a plurality of types.

(4) An embodiment of the present invention is the display control device in which, in addition to the configuration of (3) described above, the correction unit changes a correction mode sequentially in accordance with the types of the correction data which is read.

(5) An embodiment of the present invention is the display control device in which, in addition to the configuration of any one of (1) to (4) described above, the processed image is synthesized with a start image for creation in such a manner that a composition ratio of the corrected input image gradually increases from start to end of loading the correction data. The processed image is obtained by processing the corrected input image obtained through the correction process of the correction unit.

(6) An embodiment of the present invention is the display control device in which, in addition to the configuration of (5) described above, the start image is the input image.

(7) An embodiment of the present invention is the display control device in which, in addition to the configuration of (5) described above, the start image is a black image, a white image, or a monochromatic image of a different single color.

(8) An embodiment of the present invention is the display control device in which, in addition to the configuration of (5) described above, the start image is a substitute image different from the input image.

(9) An embodiment of the present invention is the display control device in which, in addition to the configuration of any one of (1) to (4) described above, the processed image is generated in such a manner that a resolution gradually increases from start to end of loading the correction data. The processed image is obtained by processing the corrected input image obtained through the correction process of the correction unit.

(10) One embodiment of the present invention is an image display method with a display control device including a correction unit that performs a correction process on an input image based on correction data. In the method, a processed image is displayed while the correction data is loaded. The processed image is obtained by processing a corrected input image. The corrected input image is obtained through the correction process of the correction unit. In the method, the corrected input image obtained through the correction process of the correction unit is displayed after completion of loading the correction data.

(11) An embodiment of the present invention is the image display method in which, in addition to the configuration of (10) described above, the correction process is performed in such a manner that strength of correction increases gradually from start to end of loading the correction data.

(12) An embodiment of the present invention is the image display method in which, in addition to the configuration of (10) or (11) described above, the correction data is loaded by sequentially reading the correction data obtained through classification into a plurality of types.

(13) An embodiment of the present invention is the image display method in which, in addition to the configuration of (12) described above, the correction unit changes a correction mode sequentially in accordance with the types of the correction data which is read.

(14) An embodiment of the present invention is the image display method in which, in addition to the configuration of any one of (10) to (13) described above, the processed image is synthesized with a start image for creation in such a manner that a composition ratio of the corrected input image gradually increases from start to end of loading the correction data. The processed image is obtained by processing the corrected input image obtained through the correction process of the correction unit.

(15) An embodiment of the present invention is the image display method in which, in addition to the configuration of (14) described above, the start image is the input image.

(16) An embodiment of the present invention is the image display method in which, in addition to the configuration of (14) described above, the start image is a black image, a white image, or a monochromatic image of a different single color.

An embodiment of the present invention is the image display method in which, in addition to the configuration of (14) described above, the start image is a substitute image different from the input image.

(18) An embodiment of the present invention is the image display method in which, in addition to the configuration of any one of (10) to (13) described above, the processed image is generated in such a manner that a resolution gradually increases from start to end of loading the correction data. The processed image is obtained by processing the corrected input image obtained through the correction process of the correction unit.

Advantageous Effects of Invention

One aspect of the present invention achieves a display control device which may reduce a time period after power-on to display of an image, and which may generate and display an image from which a user feels less stress during a period until display of the expected image obtained through correction.

One aspect of the present invention achieves an image display method with a display control device, which may reduce a time period after power-on to display of an image, and which may generate and display an image from which a user feels less stress during a period until display of the expected image obtained through correction.

DESCRIPTION OF EMBODIMENTS

First Embodiment

An embodiment of the present invention will be described in detail below.

(Configuration of a Display Control Device)

Figure 1:
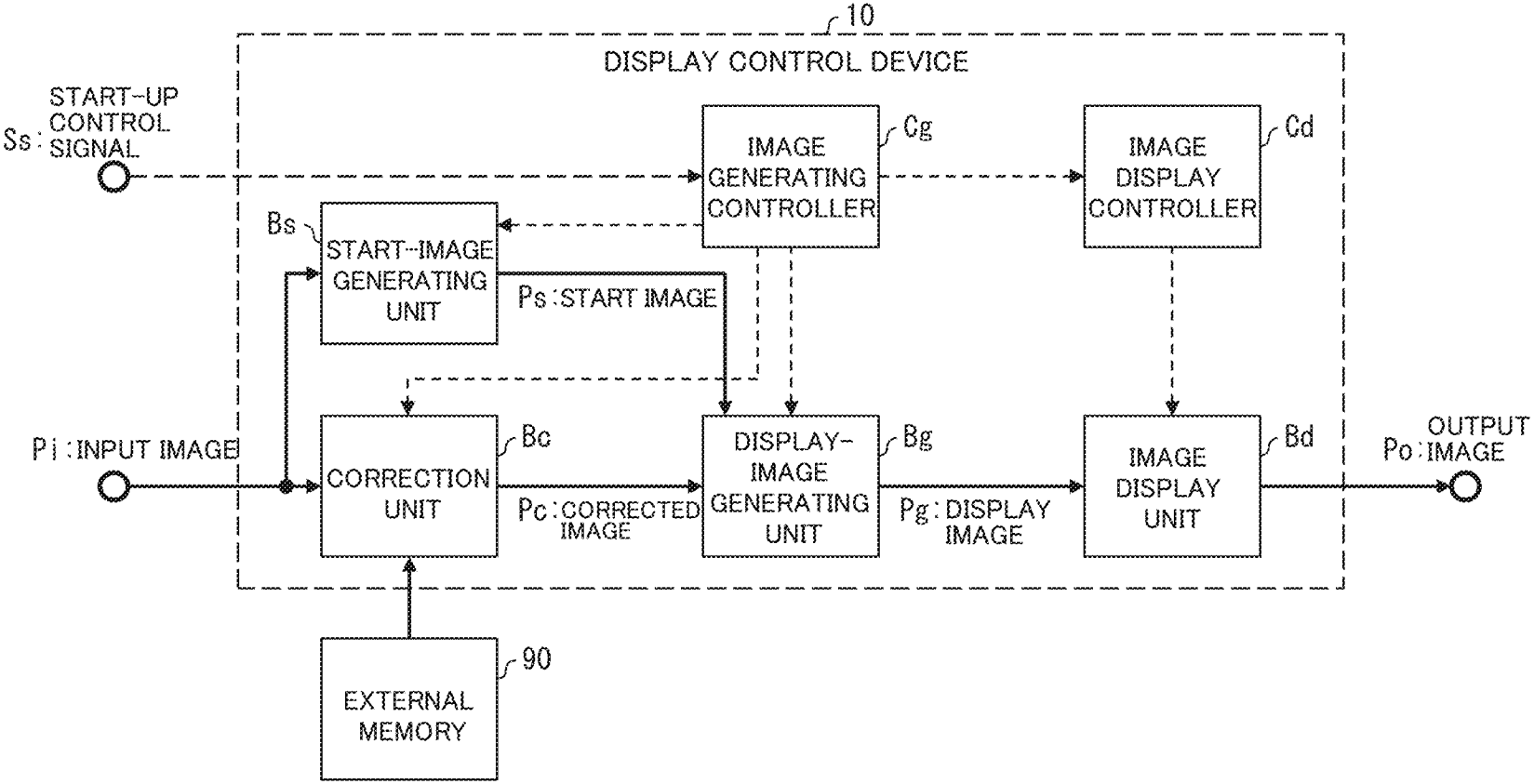
FIG. 1 is a block diagram illustrating a configuration of a display control device according to a first embodiment of the present invention.

FIG. 1 is a block diagram illustrating a configuration of a display control device 10 according to a first embodiment. FIG. 1 illustrates an external memory 90 in addition to the display control device 10.

The display control device 10 is a circuit performing control for displaying an image on a display panel, such as a liquid crystal panel or an OLED panel. The display control device 10 receives an input image Pi, and processes the received image into an image signal suitable for a specific display panel to output an output image Po. On power-on, the display control device 10, which is applied to a display apparatus including a display panel, receives a start-up control signal Ss from the display apparatus. Further, the display control device 10 loads, from the external memory 90 provided for the display apparatus, correction data for correcting image data. On powering on the display apparatus, loading the correction data is started. The loading process is performed in parallel with a process of outputting the output image Po to the display panel. On powering on and starting up the display apparatus, after that, the input image Pi continues to be input to the display control device 10 consecutively. The input image Pi is image data changing in time series. However, the input image Pi may include data having unchanging continuous images.

The display control device 10 includes a correction unit Bc, a start-image generating unit Bs, a display-image generating unit Bg, an image display unit Bd, an image generating controller Cg, and an image display controller Cd.

The input image Pi, which is received by the display control device 10, is input to the correction unit Bc and the start-image generating unit Bs. The correction unit Bc loads the correction data from the external memory 90, and outputs, to the display-image generating unit Bg, a corrected image Pc on which correction processes are performed based on the correction data on the input image Pi which has been input. The start-image generating unit Bs outputs, to the display-image generating unit Bg, a start image Ps which is image data different from the corrected image Pc.

The display-image generating unit Bg outputs, to the image display unit Bd, a display image Pg based on the corrected image Pc which is output from the correction unit Bc; a display image Pg based on the start image Ps which is output from the start-image generating unit Bs; or a display image Pg which is a synthesized image of the corrected image Pc and the start image Ps. The image display unit Bd converts, for output, the display image Pg, which is output from the display-image generating unit Bg, into the output image Po for driving a specific display panel, such as a liquid crystal panel or an OLED panel, thus causing the display panel to display an image.

On receiving the start-up control signal Ss from the display apparatus (host) side, the image generating controller Cg controls the correction unit Bc, the start-image generating unit Bs, the display-image generating unit Bg, and the image display controller Cd. The image display controller Cd controls the image display unit Bd according to instructions from the image generating controller Cg.

(Operations of the Display Control Device)

Figure 2:
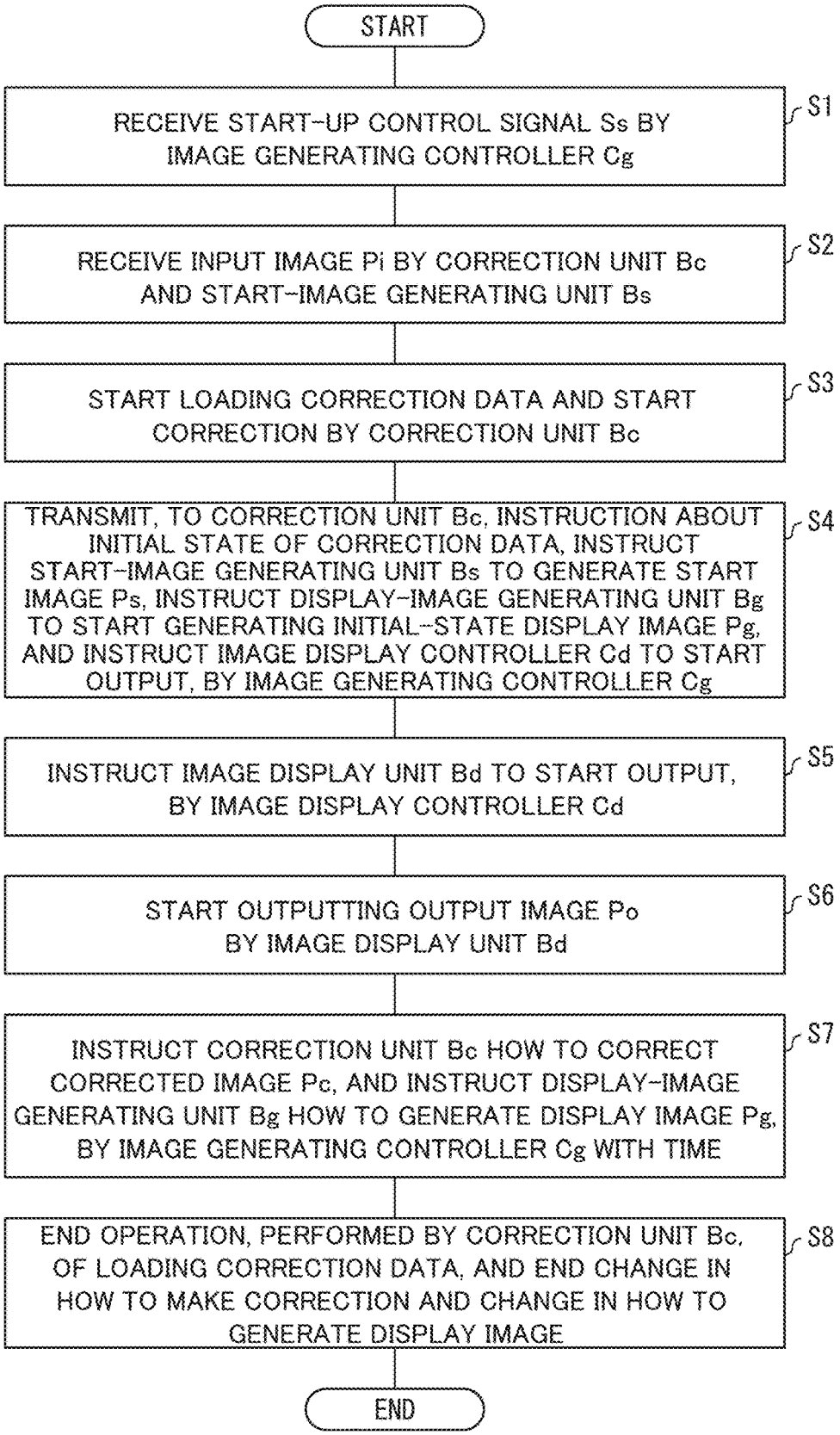
FIG. 2 is a flowchart of characteristic operations of a display control device according to the first embodiment of the present invention.

FIG. 2 is a flowchart of characteristic operations of the display control device 10 according to the first embodiment. Referring to FIG. 2, the characteristic operations of the display control device 10 will be described below.

On powering on the display apparatus, the image generating controller Cg receives the start-up control signal Ss from the display apparatus (host) side (step S1).

The input image Pi is input through an image input terminal of the display control device 10 to the correction unit Bc and the start-image generating unit Bs (step S2). Then, the correction unit Bc starts loading necessary correction data from the external memory 90. In addition, the correction unit Bc starts correcting the input image Pi at the same time (step S3).

The image generating controller Cg transmits, to the correction unit Bc, an instruction about the initial state of the correction data. Simultaneously, the image generating controller Cg instructs the start-image generating unit Bs to generate the start image Ps. Simultaneously, the image generating controller Cg also instructs the display-image generating unit Bg to start generating the display image Pg which is for the initial state and which is based on the start image Ps and the corrected image Pc. Further, the image generating controller Cg instructs the image display controller Cd to start outputting the output image Po (step S4).

The image display controller Cd instructs the image display unit Bd to start outputting the output image Po (step S5). Then, the image display unit Bd starts outputting the output image Po to the display panel on the basis of the display image Pg data from the display-image generating unit Bg (step S6).

After that, the image generating controller Cg controls the correction unit Bc, the start-image generating unit Bs, and the display-image generating unit Bg with time. The image generating controller Cg controls, with time, the correction method performed by the correction unit Bc. Simultaneously, the image generating controller Cg controls, with time, the method of generating the display image Pg which is performed by the display-image generating unit Bg (step S7).

On completion of loading the correction data, the change of the correction method performed by the correction unit Bc, and the change of the method of generating the display image Pg, which is performed by the display-image generating unit Bg, end (step S8). Thus, the series of characteristic operations of the display control device 10, which are performed on powering on the display apparatus, are completed.

Since loading the necessary correction data has been completed, after that, an image, which has been subjected to all of the necessary correction processes by the correction unit Bc, continues to be output as the output image Po. At that time, the start image Ps is not reflected in the output image Po any longer.

(A Concrete Example of Operations of the Display Control Device)

A more concrete example of the operations of the display control device 10 according to the first embodiment will be described.

In step S4, according to the instruction from the image generating controller Cg, the start-image generating unit Bs outputs the input image Pi itself without correction as the start image Ps. According to the instruction from the image generating controller Cg, the display-image generating unit Bg outputs the start image Ps as the display image Pg.

The timing at which display of an image on the display panel is started (the image display unit Bd starts outputting the output image Po) is step S6, which is a timing at which completion of the time-consuming process of loading the correction data from the external memory 90 is not waited for. Thus, after power-on, an image is displayed on the display panel promptly. The image displayed at that time is the start image Ps which is generated by the start-image generating unit Bs and which is an uncorrected image identical to the input image Pi.

In step S7, the image generating controller Cg instructs the correction unit Bc to change the correction strength and the correction mode with time. For example, the correction unit Bc changes the correction strength from 0% to 100% gradually. The correction strength of X % means that, when the correction value Cp for a pixel is calculated on the basis of the correction data, correction is applied. by Cp×X/100. The image generating controller Cg controls the correction unit Bc so that the correction strength is 100% on completion of loading the correction data.

According to the instruction from the image generating controller Cg, the display-image generating unit Bg outputs image data, which is obtained by synthesizing the start image Ps and the start image Ps, as the display image Pg. The display-image generating unit Bg changes the composition ratio of the start image Ps with respect to the corrected image Pc from 100:0 to 0:100 gradually. The image synthesis means that image data is generated by performing proportional addition on the color signals of corresponding pixels in the images with the composition ratio of the pixel images. For example, assume that the composition ratio of the corrected image Pc is Y %, and that certain color signals for corresponding pixels are represented by ps and pc for the start image Ps and the corrected image Pc, respectively. A color signal of (ps×(100−Y)+pc×Y)/100 is generated as a color signal pg of the synthesized image.

The correction data loaded by the correction unit Bc Includes many types of data, for example, Mura correction, degradation correction, and gamma correction. Thus, since there are multiple types of correction data, the correction data may be classified appropriately. For example, the correction data, which is to be loaded, may be classified stepwise into correction data related to a tendency, as a whole, of the display panel and correction data related to a local part of the display panel. It is preferable to classify the correction data, which is to be loaded, stepwise into correction data having a small amount of data and correction data having a large amount of data. Alternatively, the correction data may be classified in accordance with the influence of the result of the process of loading the correction data on the display quality.

As described above, classification of the correction data in accordance with the state, in which the present invention is carried out, enables the correction unit Bc to load the correction data in descending order of priority. Thus, without waiting for completion of loading the correction data from the external memory 90, an improved image with good display quality, which is obtained through the correction process, may be displayed on the display panel at a relatively early stage. In particular, the correction data is classified so as to be loaded in ascending order of influence of the result of the process of loading the correction data on the display screen. This particularly enables display control in which a user's recognition of the quality of an insufficiently corrected image is suppressed.

Alternatively, the correction unit Bc may change the correction mode stepwise in accordance with a partial group of correction data which has been loaded. At that time, the correction unit Bc typically performs partial correction which may be performed by using only the partial group of correction data which has been loaded. For example, the correction data is classified into three groups: correction data D1; correction data D2; and correction data D3. The correction unit Bc loads the correction data in the order of the correction data D1, the correction data D2, and the correction data D3. In loading the correction data D1, the correction unit Bc enables execution only in the correction mode for the correction data D1. When loading the correction data D2 is started, the correction unit Bc enables execution in the correction mode for the correction data D1 and the correction data D2. When loading the correction data D3 is started, the correction unit Bc enables execution in the correction mode for the correction data D1, the correction data D2, and the correction data D3.

As loading the correction data is progressed as described above, the groups of correction data which are obtained through classification into any groups are handled sequentially as a loading target. Thus, as the number of pieces of correction data that is to be loaded increases, the correction unit Bc may control the correction strength on the corrected image Pc.

The change in the correction strength defined as described above is not limited to a monotonously-increasing strength, and may be set appropriately, for example, as a stepwise-increasing strength or an increasing strength with temporary decreases. For example, the change may include a linearly-increasing correction strength. In addition, for example, the change in the correction strength may be set so that, while the correction strength increases and decreases, convergence to the correction state that is to be finally applied is achieved. In the present application, "gradually" indicates that the state transition has a tendency as a whole, and does not necessarily mean only a continuous and monotonous change. As long as the state transition has a tendency as a whole, a stepwise change in its process and a change with a temporary inverse tendency in its process are encompassed.

(Advantages)

The configuration and the characteristic operations described above enable the display control device 10 according to the first embodiment to achieve the following display control: while the time period from powering on the display apparatus to starting display is reduced, a user's recognition of an insufficient degree of correction quality of an initial image, which is displayed on the display apparatus just after the power-on, is reduced.

In particular, in step S7, the output image Po contains a gradually-increasing ratio of the corrected image Pc with respect to the start image Ps through the synthesis process. Thus, a user does not recognize the insufficient decree of correction quality of an initial image easily.

Control of the correction strength in loading the correction data enables display control in which a user's awareness of degradation in the correction quality is suppressed more effectively.

In particular, in the case of correction for achieving higher depending on an input image, a user often does not recognize degradation in the correction quality even when an uncorrected image is output. Thus, the method of changing the accuracy of the correction gradually from the uncorrected state to the final expected correction state is effective as means for making the correction effective without providing stress to a user.

Second Embodiment

A display control device according to a second embodiment will be described below. For convenience of description, components having functions identical to those of the components described in the embodiment are designated with the identical reference numerals, and will not be described. A configuration and a flow of characteristic operations of the display control device according to the second embodiment are similar to those of the display control device 10 illustrated in FIGS. 1 and 2. However, the display control device according to the second embodiment is different from the display control device 10 in the specific technique in the method of generating the display image Pg, which is performed by the display-image generating unit Bg in steps S4 and S7. In the second embodiment, in accordance with the correction unit Bc loading the correction data from the external memory, the display-image generating unit Bg changes the resolution of the corrected image Pc.

(A Concrete Example of Operations of the Display Control Device)

In the display control device 10 according to the first embodiment, the display image Pg in the initial state, which is output in step S4, is the start image Ps generated by the start-image generating unit Bs. In contrast, in the display control device according to the second embodiment, the display image Pg in the initial state is based on the corrected image Pc which is output from the correction unit Bc. In order that a user does not easily recognize reduction in the display quality of an image displayed on the display panel and image disturbances in start-up, in the second embodiment, the image generating controller Cg controls the display-image generating unit Bg in step S4 as described below.

The display-image generating unit Bg changes the resolution of the corrected image Pc, and outputs the resulting image as the display image Pg. For example, at a time point at which the correction unit Bc starts loading the correction data, the display-image generating unit Bg decreases the resolution of the corrected image Pc, which is output by the correction unit Bc, to 1/16, and outputs the resulting image as the output image Po. If a WQHD display panel is used as the display panel, an image displayed on the display panel contains 1440×2560 pixels. Decreasing the resolution to 1/16 means that, for example, 1440×2560 pixels are divided into 16×16 pixel divisions, and an image obtained by averaging the pixel signals of the pixels in each division is output for the division. Thus, a coarse image substantially having data of 90×160 pixels as a result of averaging is displayed on the display panel of 1440×2560 pixels. Alternatively, for each pixel, an image obtained by averaging the pixel signals of 16×16 pixels substantially around the pixel may be output.

Thus, after powering on the display apparatus, an image displayed on the display panel at a timing of start of display is in the state in which the correction unit Bc loads almost none of the correction data. If an image based on the corrected image Pc in the state, in which almost none of the correction data is loaded, is displayed on the display panel as it is, there may occur reduction in the display quality of the corrected image Pc, which is displayed, and image disturbances in start-up. However, in the second embodiment, the resolution of an image based on the corrected image Pc displayed on the display panel is coarse. Thus, a user does not easily recognize the state in which a sufficient amount of correction data has not been loaded. Thus, the display control device according to the second embodiment displays, on the display panel, the output image Po based on the corrected image Pc, whose resolution is decreased, at the initial stage in starting up the display apparatus. Therefore, even when an insufficient amount of correction data has been loaded, a user's recognition of the insufficient correction result may be suppressed.

The change in the method of generating the display image Pg, which is performed by the display-image generating unit Bg, in step S7 described above will be described in more detail. In step S7, the image generating controller Cg controls the display-image generating unit Bg as described below.

The image generating controller Cg instructs the display-image generating unit Bg to change, with time, the process of changing the resolution of the corrected image Pc and outputting the resulting image as the display image Pg. As the screen in the initial state which is set in step S4, a coarse image, whose resolution is 1/16, is displayed on the display panel. In step S7, the resolution of the output image Po is changed from 1/16 to 1/8, 1/4, and 1/2 in this sequence in step S7. At a time point at which the correction unit Bc ends loading the correction data, the resolution becomes 1/1. At any timing, the image data size of the output image Po is constant. That is, the screen displayed on the display panel transitions from an image having a coarse resolution to an image having an improved resolution.

As the correction unit Bc loads the correction data, the resolution of the output image Po displayed on the image panel is made high. Thus, compared with the process of the related art in which an initial image continues to be displayed, a user may grasp the progress of loading the correction data, without recognizing the state in which an insufficient amount of correction data is loaded. That is, according to the transition of the display screen with the correction data being loaded, the resolution of the output image Po is improved, enabling a user to recognize the correct result of correction.

In accordance with the state of the operation, for example, at a timing at which the correction unit Bc loads almost none of the correction data, the start image Ps instead of the corrected image Pc may be displayed.

The second embodiment also achieves display control in which, while the time period from powering on the display apparatus to starting display is reduced, a user's recognition of an insufficient degree of correction quality of an initial image, which is displayed on the display apparatus just after the power-on, is reduced. In addition, the second embodiment also achieves effects similar to those of the first embodiment.

In the second embodiment, the display-image generating unit Bg changes the resolution of the corrected image Pc, particularly achieving a more effective suppression of a user's awareness of an insufficient degree of correction quality at the initial stage in starting up the display apparatus.

Third Embodiment

A display control device according to a third embodiment will be described below. A configuration and a flow of characteristic operations of the display control device according to the third embodiment are similar to those of the display control device 10 illustrated in FIGS. 1 and 2. However, the display control device according to the third embodiment is different from the display control device 10 in a concrete example of the method of generating the display image Pg which is performed by the display-image generating unit Bg in steps S4 and S7. In the third embodiment, the start image Ps generated by the start-image generating unit Bs is different from the input image Pi.

(A Concrete Example of Operations of the Display Control Device)

Figure 3A:
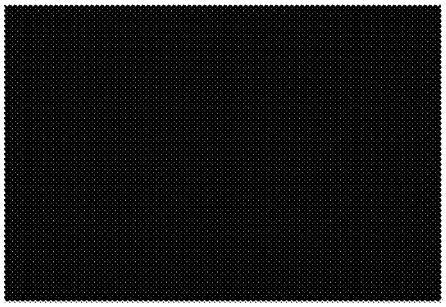
FIG. 3A illustrates a black-image example as a start-image in a display control device according to a third embodiment of the present invention.
Figure 3B:
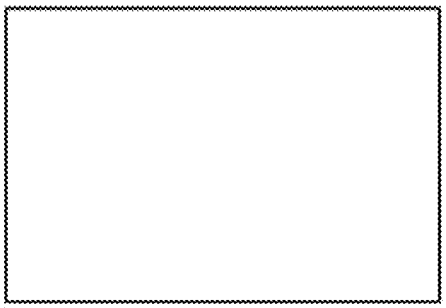
FIG. 3B illustrates a white-image example as a start-image in the display control device according to the third embodiment of the present invention.

In the display control device 10 according to the first embodiment, the start image Ps which is output from the start-image generating unit Bs in step S4 is the input image Pi. In contrast, in the display control device according to the third embodiment, the start image Ps is, for example, (case 1) an monochromatic image, such as a black image or a white image, (case 2) a random pattern image such as a noise screen, or (case 3) a substitute image. FIG. 3 includes diagrams illustrating the start images Ps of the display control device according to the third embodiment. FIG. 3A illustrates a black image which is an example of case 1. FIG.

Figure 3C:
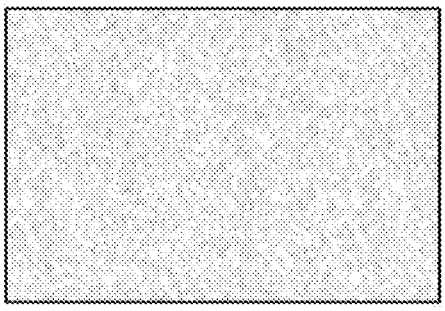
FIG. 3C illustrates a random pattern image example as a start-image in the display control device according to the third embodiment of the present invention.
Figure 3D:
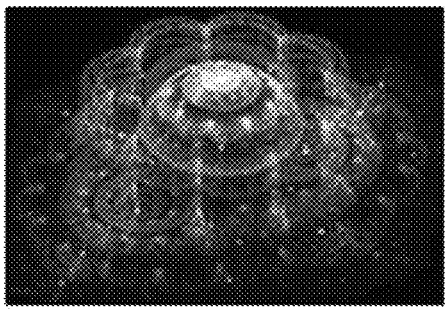
FIG. 3D illustrates a substitute image example as a start-image in the display control device according to the third embodiment of the present invention.

3B illustrates a white image which is an example of case 1. FIG. 3C illustrates a random pattern image example of case 2. FIG. 3D illustrates a substitute image example of case 3. According to an instruction from the image generating controller Cg, the display-image generating unit Bg outputs the start image Ps as the display image Pg.

The timing at which display of an image on the display panel starts (the image display unit Bd starts output of the output image Po) is step S6, which is a timing at which completion of the time-consuming process of loading the correction data from the external memory 90 is not waited for. Thus, an initial screen is displayed on the display panel promptly after power-on. The initial image displayed at that time is the start image Ps generated by the start-image generating unit Bs, which is an image of any case described above.

In step S7, the display-image generating unit Bg in the display control device according to the third embodiment operates similarly to the case of the display control device 10 according to the first embodiment. That is, at a time point at which the correction unit Bc starts loading the correction data, the image generating controller Cg controls the display-image generating unit Bg so that the composition ratio of the start image Ps with respect to the corrected image Pc is 100:0. As the correction unit Bc advances the process of loading the correction data, control is exerted so that the ratio of the corrected image Pc is increased to the composition ratio, 0:100, of the start image Ps with respect to the corrected image Pc.

When a monochromatic image (case 1) is selected as the start image Ps, the monochromatic image based on the start image Ps is displayed on the display panel at a time point at which the correction unit Bc starts loading the correction data. As the correction unit Bc advances the process of loading the correction data, the display screen on the display panel transitions gradually from the monochromatic image to the corrected image. Such an image transition suppresses a user's awareness of an insufficient degree of correction quality of the image data at the initial stage in starting up the display apparatus. More specifically, if the start image Ps is a black image, an initial dark image, from which it is difficult to recognize an insufficient degree of correction quality, transitions gradually to a bright fully-corrected image. If the start image Ps is a white image, an initial low-contrast image, from which it is difficult to recognize an insufficient degree of correction quality, transitions gradually to a high-contrast fully-corrected image.

If a random pattern image (case 2) or a substitute image (case 3) is selected, a random pattern image or a substitute image based on the start image Ps is displayed on the display panel at a time point at which the correction unit Bc starts loading the correction data. As the correction unit Bc advances the process of loading the correction data, the display-image generating unit Bg controls the composition ratio with respect to the corrected image Pc. Thus, the display screen transitions from the random pattern image or the substitute image to the expected image to which the correction processes have been applied. Due to the transition of the display screen described above, display of a substitute image suppresses a user's recognition of degradation in the correction quality of the image data at the initial stage in starting up the display apparatus.

The third embodiment also achieves effects similar to those in the embodiments.

[Implementation Examples Using Software]

The display control device according to each aspect of the present invention may be implemented by using logic circuits (hardware) formed of integrated circuits (IC chips), or may be implemented by using software.

In the latter case, the display control device includes a computer which executes instructions of programs which are software implementing the functions. The computer includes, for example, at least one processor (control device), and includes at least one computer-readable recording medium storing the programs. In the computer, the processor reads and executes the programs from the recording medium, thus achieving the object of the present invention. As the processor, for example, a CPU (Central Processing Unit) may be used. As the recording medium, a "non-transitory tangible medium", such as a ROM (Read Only Memory), a tape, a disk, a card, a semiconductor memory, or a programmable logic circuit, may be used. In addition, a RAM (Random Access Memory) and the like on which the programs are loaded may be further included. The programs may be supplied to the computer through any transmission medium (such as a communication network or broadcast waves) on which the programs may be transmitted. An aspect of the present invention may be achieved in the form of data signals, which are embedded in carrier waves and in which the programs are embodied through electrical transmission.

The display control device according to each aspect of the present invention may be implemented by using a computer. In this case, a display control program of the display control device and a computer-readable recording medium, on which the display control program is recorded, are encompassed in the scope of the present invention. The display control device is implemented by using a computer which operates as each unit (software component) included in the display control device.

The present invention is not limited to the embodiments described above. Various changes may be made in the scope of the claims. An embodiment obtained by combining appropriately technical means disclosed in the different embodiments is also encompassed in the technical scope of the present invention. Further, a combination of technical means disclosed in the embodiments may form novel technical characteristics.

REFERENCE SIGNS LIST

10 display control device
90 external memory
Bc correction unit
Bs start-image generating unit
Bg display-image generating unit
Bd image display unit
Cg image generating controller
Cd image display controller
Pi input image
Pc corrected image
Ps start image
Pg display image
Po output image
Ss start-up control signal

The invention claimed is:

1. A display control device comprising:

a correction unit that performs a correction process on an input image based on correction data, wherein, after a portion of the correction data is loaded, a processed image is output, the processed image being obtained by processing a corrected input image, the corrected input image being obtained through a portion of the correction process of the input image performed by the correction unit based on the portion of the correction data, and wherein, after completion of loading all portions of the correction data, a corrected input image obtained through all portions of the correction process of the input image performed by the correction unit based on all portions of the correction data is output.

2. The display control device according to claim 1, wherein the correction unit performs the correction process in such a manner that strength of correction increases gradually from start to end of loading the correction data.

3. The display control device according to claim 1, wherein the correction data are loaded by sequentially reading the correction data obtained through classification into a plurality of types.

4. The display control device according to claim 3, wherein the correction unit changes a correction mode sequentially in accordance with the types of the correction data which are read.

5. The display control device according to claim 1, wherein the processed image is synthesized with a start image for creation in such a manner that a composition ratio of the corrected input image gradually increases from start to end of loading the correction data, the processed image being obtained by processing the corrected input image obtained through the correction process of the correction unit.

6. The display control device according to claim 5, wherein the start image is the input image.

7. The display control device according to claim 5, wherein the start image is a black image, a white image, or a monochromatic image of a different single color.

8. The display control device according to claim 5, wherein the start image is a substitute image different from the input image.

9. The display control device according to claim 1, wherein the processed image is generated in such a manner that a resolution gradually increases from start to end of loading the correction data, the processed image being obtained by processing the corrected input image obtained through the correction process of the correction unit.

10. An image display method with a display control device including a correction unit that performs a correction process on an input image based on correction data, the method comprising:

displaying a processed image after a portion of the correction data is loaded, the processed image being obtained by processing a corrected input image, the corrected input image being obtained through a portion of the correction process of the input image performed by the correction unit based on the portion of the correction data; and displaying a corrected input image obtained through all portions of the correction process of the input image performed by the correction unit based on all portions of the correction data, after completion of loading all portions of the correction data.

11. The image display method according to claim 10, wherein the correction process is performed in such a manner that strength of correction increases gradually from start to end of loading the correction data.

12. The image display method according to claim 10, wherein the correction data are loaded by sequentially reading the correction data obtained through classification into a plurality of types.

13. The image display method according to claim 12, wherein the correction process is performed in such a manner that a correction mode is changed sequentially in accordance with the types of the correction data which are read.

14. The image display method according to claim 10, wherein the processed image is synthesized with a start image for creation in such a manner that a composition ratio of the corrected input image gradually increases from start to end of loading the correction data, the processed image being obtained by processing the corrected input image obtained through the correction process of the correction unit.

15. The image display method according to claim 14, wherein the start image is the input image.

16. The image display method according to claim 14, wherein the start image is a black image, a white image, or a monochromatic image of a different single color.

17. The image display method according to claim 14, wherein the start image is a substitute image different from the input image.

18. The image display method according to claim 10, wherein the processed image is generated in such a manner that a resolution gradually increases from start to end of loading the correction data, the processed image being obtained by processing the corrected input image obtained through the correction process of the correction unit.

* * * * *